US011519192B2

(12) United States Patent
Bruneel et al.

(10) Patent No.: US 11,519,192 B2
(45) Date of Patent: Dec. 6, 2022

(54) SUCTION HEAD WITH CENTRAL DEFLECTOR FOR CLEANING SWIMMING POOLS

(71) Applicant: KOKIDO DEVELOPMENT LIMITED, Kowloon (HK)

(72) Inventors: Jean Bruneel, Kowloon (HK); Max Roumagnac, Martignas sur Jalle (FR)

(73) Assignee: KOKIDO DEVELOPMENT LIMITED, Kowloon (HK)

( * ) Notice: Subject to any disclaimer, the term of this patent is extended or adjusted under 35 U.S.C. 154(b) by 90 days.

(21) Appl. No.: 17/104,324

(22) Filed: Nov. 25, 2020

(65) Prior Publication Data

US 2021/0164252 A1 Jun. 3, 2021

(30) Foreign Application Priority Data

Dec. 2, 2019 (FR) ..... 19 13598

(51) Int. Cl.
*E04H 4/16* (2006.01)

(52) U.S. Cl.
CPC ..... *E04H 4/1672* (2013.01); *E04H 4/1636* (2013.01)

(58) Field of Classification Search
CPC ..... E04H 4/16; E04H 4/1654; E04H 4/1672
See application file for complete search history.

(56) References Cited

U.S. PATENT DOCUMENTS

| | | | | |
|---|---|---|---|---|
| 3,075,227 | A | 1/1963 | Bowles | |
| 3,755,843 | A | 9/1973 | Goertzen, III et al. | |
| 5,709,793 | A * | 1/1998 | Kisner | E04H 4/1281 239/149 |
| 5,768,734 | A | 6/1998 | Dietrich | |
| 6,942,790 | B1 | 9/2005 | Dolton | |
| 2014/0271175 | A1* | 9/2014 | Kumar | E04H 4/1654 415/224.5 |
| 2015/0128361 | A1 | 5/2015 | Erlich et al. | |

FOREIGN PATENT DOCUMENTS

| | | |
|---|---|---|
| EP | 0 989 255 A1 | 3/2000 |
| FR | 2 683 845 A1 | 5/1993 |
| FR | 3 080 879 A1 | 11/2019 |

* cited by examiner

*Primary Examiner* — Michael D Jennings
(74) *Attorney, Agent, or Firm* — IPside; C. Andrew Im; Jean C. Hamann

(57) ABSTRACT

A suction head for submersible use in the water of an artificial pool. The suction head having a body provided with a suction duct and a suction pump placed inside the suction duct. The suction pump includes an electric motor coupled to a propeller. The rotation of the propeller producing suction along the suction duct between a suction mouth and an upper opening of the duct. The suction head further includes a central deflector placed between the motor and the propeller so as to prevent bulky debris from piling up below the propeller and discharging it to the periphery of the suction duct.

12 Claims, 3 Drawing Sheets

PRIOR ART

SUCTION HEAD WITH CENTRAL DEFLECTOR FOR CLEANING SWIMMING POOLS

RELATED APPLICATIONS

This application claims priority from French Patent Application No. 19 13598 filed Dec. 2, 2019, which is incorporated herein by reference in its entirety.

TECHNICAL FIELD

The present invention belongs to the field of maintenance equipment for swimming pools and other artificial pools, in particular swimming pool vacuum cleaners, and concerns more particularly a suction head with central deflector for cleaning swimming pools and a vacuum cleaner brush equipped with such a suction head.

BACKGROUND OF THE INVENTION

The use of vacuum cleaner devices for cleaning swimming pool floors is known. The suction enables the debris precipitated on the floor of a swimming pool to be reached more effectively than a conventional swimming pool brush which requires, in addition to long and tedious sweeping, collection of the heaped debris using a bottom net, for example.

Swimming pool vacuum cleaners are widely marketed and can be chosen according to the specifications of each pool. In addition to robots enabling automatic cleaning according to programmed cycles, electric and autonomous vacuum cleaner brushes exist, operating on a battery, which generally have a suction head connected to a handle. The interest here is in this latter category.

Vacuum cleaner brushes can be classed in two types according to their design, filter vacuum cleaner brushes and bagged (or netted) vacuum cleaner brushes.

On the one hand, a filter vacuum cleaner brush mainly comprises a suction head, a filter and a suction pump, and enables relatively heavy and small-volume debris to be sucked up. During the suction, the debris is stored in a compartment partially delimited by the filter. This type of suction brush is not suitable for sucking up bulky debris, such as leaves for example, because of a low free height between the floor of the pool and the suction head, as well as a low storage volume in the debris compartments.

Such a vacuum cleaner brush is described, for example, in document U.S. Pat. No. 3,755,843.

On the other hand, a bagged vacuum cleaner brush mainly comprises a propeller pump which delivers raw water sucked into a large-capacity bag placed above the pump. Document U.S. Pat. No. 3,075,227 describes an apparatus of this type. This vacuum cleaner has certain disadvantages, such as the reduced cross-section of the suction duct which may cause the suction duct to be blocked by bulky debris. This design is likely to make the vacuum cleaner unusable for sucking up leaves.

American patent U.S. Pat. No. 5,768,734 describes a vacuum cleaner which overcomes the reduced cross-section of the suction duct, and the design of which has been marketed under several registered trademarks: Hammer Head, Power Vac, Riptide, etc.

Document US 20150128361 describes a vacuum cleaner of similar design but reduced power, supplied by electrical batteries. This vacuum cleaner marketed by Watertech is exclusively adapted to collecting leaves and is mainly intended for private swimming pools.

Document FR 3080879, in the name of the applicant and a figure of which is reproduced in FIG. 1, describes a modular suction head which can adapt exclusively to both filter vacuum cleaner brushes and bagged vacuum cleaner brushes (leaf collection). This latter use nevertheless has the disadvantage of accumulating leaves between the motor and propeller of the suction pump. Indeed, the leaves and other bulky debris that is sucked up tend to pile up below the propeller, which necessarily has a larger radius than the body of the motor, and risk altering the operation of said propeller, or even blocking its rotation due to clogging, and thus damaging the motor

OBJECT AND SUMMARY OF THE INVENTION

The present invention aims to overcome the disadvantages of the prior art described above, in particular the problem of accumulation of bulky debris below the suction pump propeller, which can lead to clogging of the pump.

To this effect, the present invention relates to a suction head, intended for submersible use in the water of an artificial pool, having a body, provided with a suction duct, and a suction pump, placed inside the suction duct and comprising an electric motor coupled to a propeller, the rotation of the propeller producing suction along the suction duct between a suction mouth and an upper opening of said duct. This suction head is characterised in that it comprises a central deflector placed between the motor and the propeller, so as to prevent bulky debris from accumulating below said propeller.

Advantageously, the central deflector is integral with the propeller and is driven by the same rotational movement as the latter, for improved discharge of bulky debris to the periphery of the suction duct.

Alternatively, the central deflector is integral with a motor unit containing the motor, and remains stationary during the rotation of the propeller.

More particularly, the central deflector is coaxial with an axis of rotation of the propeller.

According to an embodiment of the invention, the central deflector has a planar shape extending radially over a radius less than the radius of the propeller.

For example, the central deflector is a disc through which a shaft of the motor passes.

According to another embodiment of the invention, the central deflector has a curved shape.

Alternatively, the central deflector has an upper wall, placed between the motor and the propeller, and a side wall converging towards said motor. For example, the upper wall and the side wall are respectively flat circular and curved frustoconical.

In a practical manner, the upper opening of the suction duct is delimited by an annular rim suitable for interacting with a flexible container for collecting bulky debris, such as a bag or a net.

According to an embodiment of the invention, the suction head also has a sleeve, capable of receiving a handle or a vacuum cleaner brush, and an electrical battery powering the suction pump, said battery being rechargeable, removable and placed in a sealed compartment of the body.

The invention also relates to a vacuum cleaner brush, or a vacuum cleaner robot, for cleaning swimming pool floors, equipped with a suction head having one or more features described above.

The fundamental concepts of the invention have been explained above in the most elementary form, other details and features will emerge more clearly on reading the description which follows and with reference to the attached drawings, given by way of a non-limiting example of an embodiment of a suction head in accordance with the principles of the invention.

BRIEF DESCRIPTION OF THE DRAWINGS

The various figures and the elements of a given figure are not necessarily represented on the same scale. Over all the figures, identical or equivalent elements have the same reference number.

The figures show.

DETAILED DESCRIPTION OF THE EMBODIMENTS

In the embodiment described below, reference is made to an improved suction head, mainly intended to equip bagged vacuum cleaner brushes for cleaning the swimming pool floors. This non-limiting example is given for a better understanding of the invention and does not exclude the use of the suction head in swimming pool robots for example, or its adaptation to filter vacuum cleaner brushes.

Figure 1:
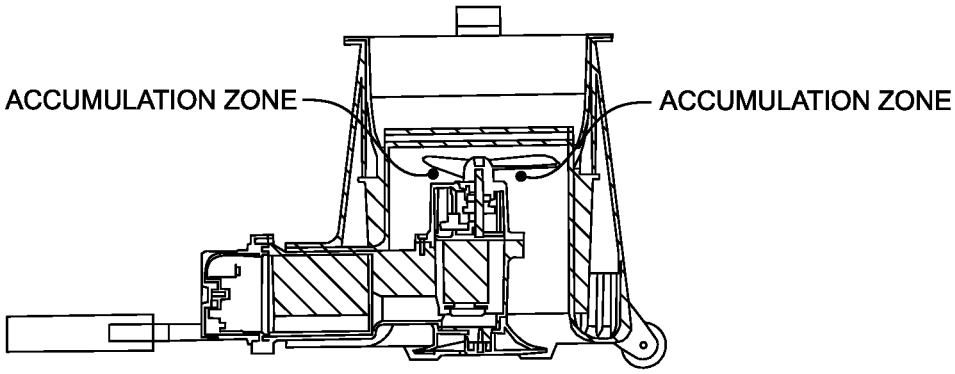
FIG. 1 (already cited), a suction head of the prior art.
Figure 2:
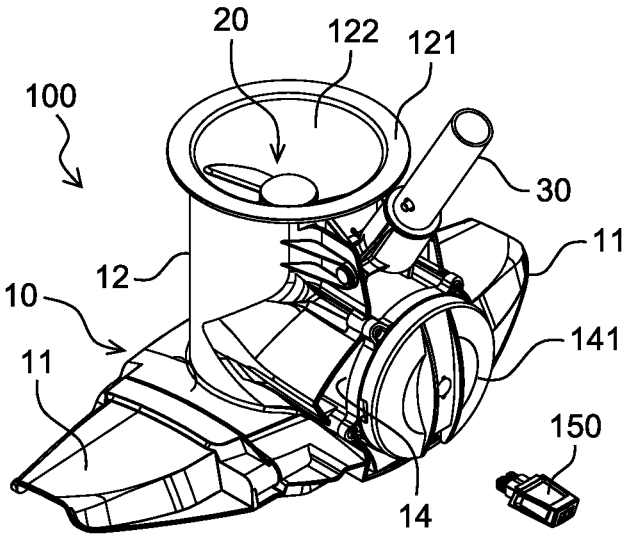
FIG. 2, a rear perspective view of a suction head according to an embodiment of the invention.
Figure 3:
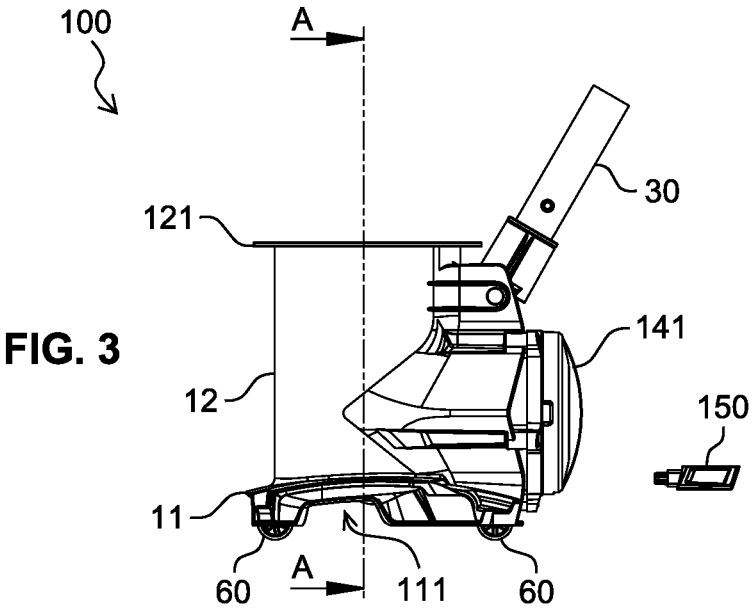
FIG. 3, a side view of the suction head of FIG. 2.
Figure 5:
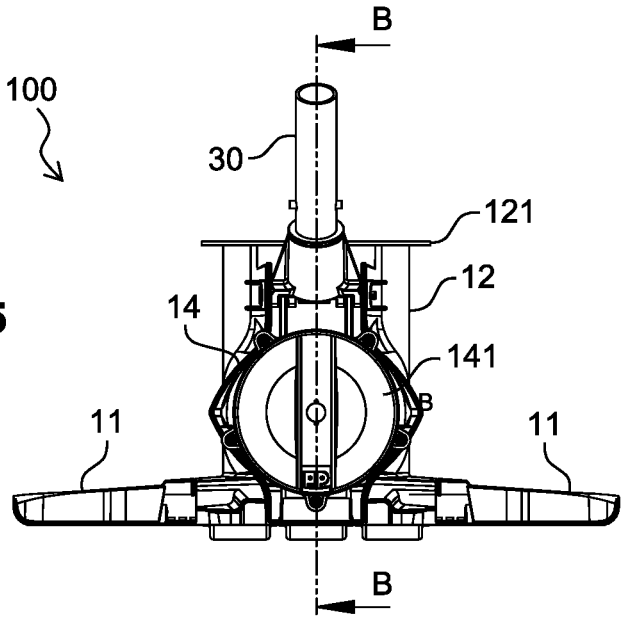
FIG. 5, a rear view of the suction head of FIG. 2.

FIGS. 2, 3 and 5 show a suction head 100 mainly having a body 10 forming its outer shell, a propeller pump 20 for suction of debris, a sleeve 30 suitable for receiving a handle (not illustrated), and a battery 40 powering the pump and placed in a compartment 14 of the body.

The body 10, according to the illustrated embodiment, has a lower shell 11, provided with a suction mouth 111, and a suction duct 12 surmounting said shell. The body 10 may be formed in a single unit, manufactured by moulding, injection, additive manufacturing or by any other suitable method; or even as a plurality of assembled parts. The body 10 is preferably manufactured from a resistant plastic material suitable for a submersible use.

The lower shell 11 has an elongated shape in a direction substantially perpendicular to the direction of movement of the suction head 100, narrowing at its lateral ends. The suction mouth 111, visible in FIGS. 3 and 4, is located in a central part of the lower shell 11, directly below the suction duct 12.

The suction duct 12 has a tubular, preferably cylindrical, shape, extending perpendicularly to a median plane of the lower shell 11, communicating at its lower end with the suction mouth 111, and terminated at its upper end by an annular rim 121 which defines an upper opening 122 through which the debris passes to a debris collection bag that is not shown.

Hence, the suction duct 12 defines an inner volume, between the suction mouth 111 and its upper opening 122, in which volume the suction pump 20 is placed.

Figure 4:
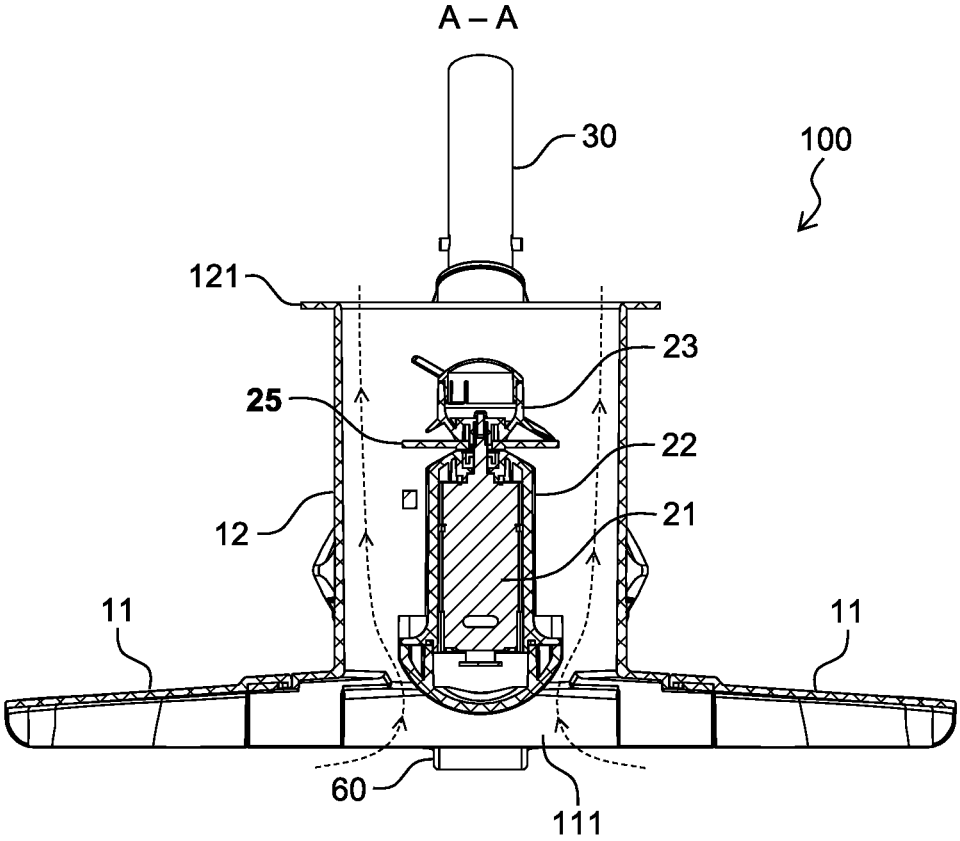
FIG. 4, a sectional view of the suction head of FIG. 2 in the plane A-A, allowing the central deflector to be seen.
Figure 6:
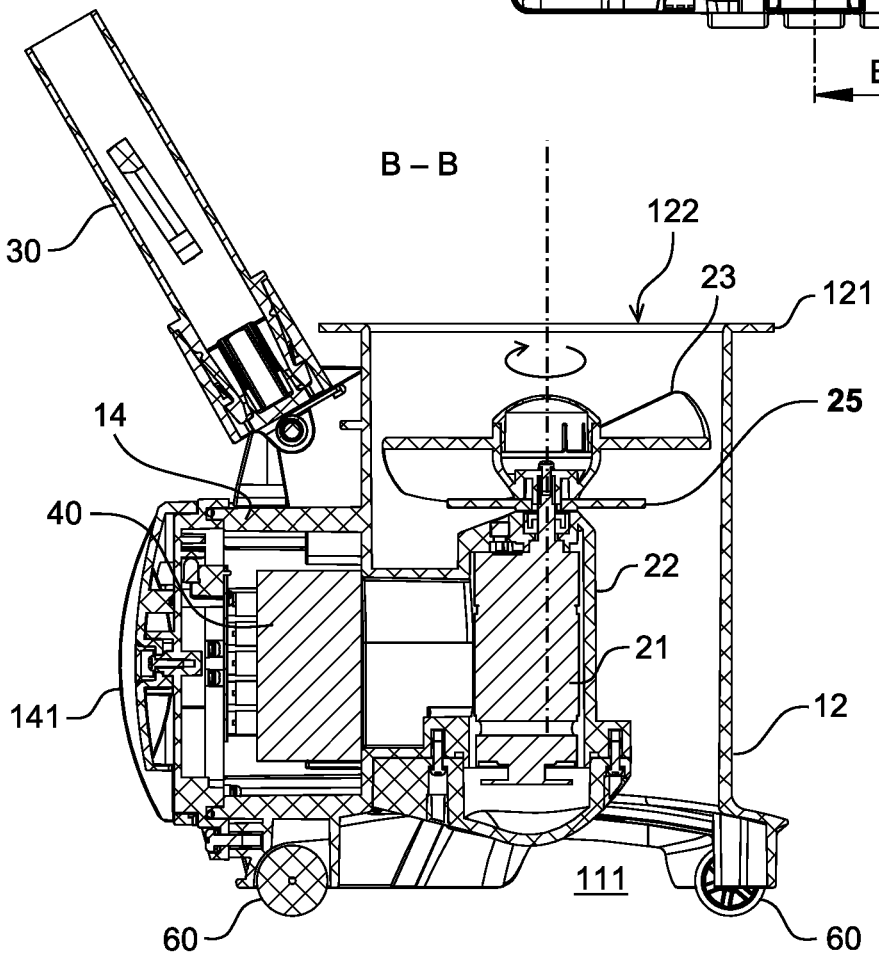
FIG. 6, a sectional view of the suction head of FIG. 4 in the plane B-B, allowing the central deflector to be seen.

The suction pump 20, according to the exemplary embodiment illustrated in FIGS. 4 and 6, comprises an electric motor 21 coupled to a propeller 23 the rotation of which produces the suction of the water, and therefore of the debris, along the suction duct 12 between the suction mouth 111 and the upper opening 122. The suction takes place along lines of current, represented by dashed lines in FIG. 4, which pass close to the blades of the propeller 23, and can therefore cause an accumulation of bulky debris, such as leaves, between the propeller 23 and the motor 21, as is the case for vacuum cleaners of the prior art.

In order to counter the occurrence of such an accumulation of debris, the suction pump 20 is provided with a central deflector 25, positioned between the motor 21 and the propeller 23, preventing the bulky debris that is sucked up from piling up below said propeller. The central deflector 25 is preferably integral with the propeller 23 and is driven by the same rotational movement as the latter, in order to chase the bulky debris that is sucked up to the periphery of the suction duct 12.

The central deflector 25, according to the exemplary embodiment of FIGS. 4 and 6, has in the form of a disc, or ring, placed coaxially with the propeller 23 and extending radially over a sufficient radius that the sucked-up bulky debris avoids the rotating blades of the propeller 23 and passes close to the walls of the suction duct 12 without hampering the rotation of said propeller. By contrast, the radius of the central deflector 25 must be less than that of the propeller 23 in order that the suction is established in the suction duct 12.

The central deflector can nevertheless have a different shape and dimensions in alternative embodiments which are not shown. For example, the central deflector can be convex or have a specific curvature, in order to facilitate the discharge of the bulky debris to the periphery of the suction duct.

In addition to an upper planar circular wall forming a screen above the propeller, the central deflector can have a frustoconical side wall converging towards the motor 21 from the edge of the planar wall, thus facilitating the discharge of bulky debris towards the periphery of the propeller 23. The frustoconical wall can be slightly curved for greater effectiveness. In the case of a central deflector with a non-circular upper wall, in the shape of a square for example, the side wall has a pyramid shape for example, each of the faces of which is associated with one side of the square.

When the central deflector includes a discharge side wall as described above, it is no longer necessary for said deflector to be coupled to rotate with the propeller, and said side wall can be integral with a housing 22 of the motor 21, or even manufactured in one piece with said housing.

In view of the description given of the central deflector, it should be noted that other variant embodiments can be trivially envisaged and that the main aspect of the invention resides in the presence of an obstacle between the motor and propeller, which prevents the accumulation of bulky debris at this precise location and thus the clogging of the suction pump.

The suction head 100 can equip a vacuum cleaner brush via the sleeve 30 which can receive a handle of said brush by clipping or by any other quick attachment means. For improved handling, the sleeve 30 is articulated on the body 10 and can pivot in a plane perpendicular to the plane of movement of the suction head and parallel to the direction of movement of said head.

The movement of the suction head 100 is performed, for example, by rolling members such as wheels or rollers 60.

In addition, the suction head 100 comprises other devices such as a charging adapter 150 for the battery.

The suction head thus described has direct application in swimming pool vacuum cleaners.

The invention claimed is:

1. A suction head, for submersible use in the water of an artificial pool, comprising:

a body provided with a suction duct and a suction pump placed inside the suction duct, the suction pump comprising an electric motor coupled to a propeller, wherein a rotation of the propeller produces suction along the suction duct between a suction mouth and an upper opening of the suction duct; and a central deflector placed between the electric motor and the propeller to prevent debris from accumulating below the propeller.

2. The suction head of claim 1, wherein the central deflector is integral with the propeller and is driven by a same rotational movement as the propeller, to discharge of the debris to a periphery of the suction duct.

3. The suction head of claim 1, wherein the central deflector is integral with a motor unit comprising the electric motor.

4. The suction head of claim 1, wherein the central deflector is coaxial with an axis of rotation of the propeller.

5. The suction head of claim 1, wherein the central deflector has a planar shape extending radially over a radius less than the radius of the propeller.

6. The suction head of claim 5, wherein the central deflector is a disc through which a shaft of the electric motor passes.

7. The suction head of claim 1, wherein the central deflector has a curved shape.

8. The suction head of claim 1, wherein the central deflector comprises a side wall converging toward the electric motor, and an upper wall placed between the electric motor and the propeller.

9. The suction head of claim 1, wherein the upper opening is delimited by an annular rim of the suction duct configured to interact with a flexible container to collect the debris.

10. The suction head of claim 9, wherein the flexible container is a bag or a net.

11. The suction head of claim 1, further comprising a sleeve configured to receive a handle of a vacuum cleaner brush, and an electrical battery to power the suction pump.

12. A vacuum cleaner brush to clean swimming pool floors, the vacuum cleaner comprising:

a suction head, for submersible use in the water of an artificial pool, comprising:

a body provided with a suction duct and a suction pump placed inside the suction duct, the suction pump comprising an electric motor coupled to a propeller, wherein a rotation of the propeller produces suction along the suction duct between a suction mouth and an upper opening of the suction duct; and a central deflector placed between the electric motor and the propeller to prevent debris from accumulating below the propeller.

* * * * *